United States Patent [19]

Dordi et al.

[11] Patent Number: 4,794,873

[45] Date of Patent: Jan. 3, 1989

[54] GUIDE APPARATUS FOR THE BEADING TO CONNECT THE COMPONENTS OF A COVER FOR MATTRESSES OR THE LIKE

[75] Inventors: GianMaria Dordi, Frosinone; Gianfranco Fiorini, Latina, both of Italy

[73] Assignee: Permaflex, S.p.A., Italy

[21] Appl. No.: 76,540

[22] Filed: Jul. 22, 1987

[30] Foreign Application Priority Data

Jul. 24, 1986 [IT] Italy ..... 9447 A/86

[51] Int. Cl.[4] ..... D05B 11/00

[52] U.S. Cl. ..... 112/2.1

[58] Field of Search ..... 112/2.1, 2.2, 2, 121.15, 112/303

[56] References Cited

U.S. PATENT DOCUMENTS

| | | | |
|---|---|---|---|
| 1,513,090 | 10/1924 | Collett | 112/2.1 |
| 1,947,058 | 2/1934 | Pittoni | 112/2.1 |
| 3,083,654 | 4/1963 | Cash | 112/2.1 |
| 3,360,262 | 12/1967 | Kekopoules et al. | 112/2 X |
| 3,487,796 | 1/1970 | Sanders | 112/2.1 |
| 3,641,954 | 2/1972 | Kalning | 112/2.1 |
| 4,067,269 | 1/1978 | Fanghanel | 112/2.1 |

*Primary Examiner*—H. Hampton Hunter

*Attorney, Agent, or Firm*—McGlew and Tuttle

[57] ABSTRACT

The guide apparatus comprises: a fixed structure with perimetrical tracks for a beading machine; a frame for a template for the assembly of the cover components; orthogonally extending guide means for the displacement of said frame in its plane with a limited inclination with respect to said tracks. Thrust means can be activated and deactivated according to the position reached by the beading machine along the tracks, in order to move, in a predetermined fashion, the template close to particular zones of the track means are provided to secure the frame to the structure in alignment with to the curved trajectories of the beading machine, and to release the frame to set free the movements thereof during the beading of the same curves.

9 Claims, 4 Drawing Sheets

Fig. 5
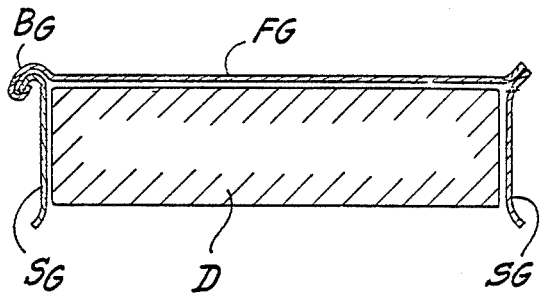
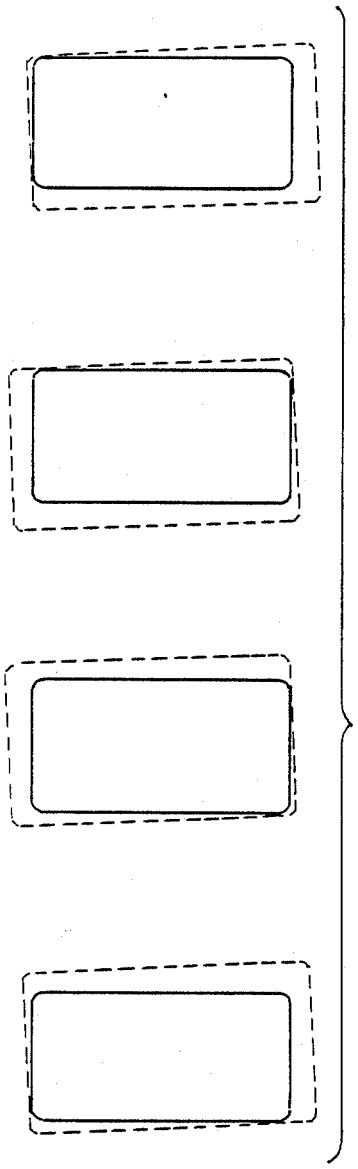
Fig. 6

GUIDE APPARATUS FOR THE BEADING TO CONNECT THE COMPONENTS OF A COVER FOR MATTRESSES OR THE LIKE

The object of the invention is to provide a guide apparatus for the beading, that is, bordering for the connection of a front component and of a side strip of a mattress sheath or cover or the like, by using a beading or bordering machine.

According to the invention, the apparatus comprises:

a fixed structure with perimetrical tracks for a beading machine;

a frame for a mattress-shaped template provided for the assembly of the cover components;

orthogonally extending guide means for the displacements of said frame in its plane and to itself with a limited inclination in respect to said tracks;

thrust means that can be activated and deactivated according to the position reached by the beading machine along the tracks, in order to move, in according to a pre-determined sequence, the template close to particular zones of the track;

means for securing the frame to the structure in alignment with the curved trajectories of the beading machine, and for releasing the frame for free movement thereof during the beading of corresponding curves of the mattress sheath; and means for elastically urging the frame to ensure the juxtapositioning of the template to the trajectory of the beading machine.

The template frame may be urged by cylinder-piston systems acting on pawls and capable of moving away therefrom; means are also provided for the timely control of the selective and programmed feeding to said systems. In practice, the apparatus may comprise limit switches in the vicinity of the corners of the tracks trajectory defined by the track for the beading machine, said limit switches being influenced, that is actuated, by the beading machine to operate said cylinder-piston systems act on the frame and the mattress therewith in a predetermined but elastic manner according to the beading requirements, and thus position the frame itself in correspondence with the tracks of the beading machine at the appropriate time.

The frame for the template may include template retaining, edge means operable to upstand for retaining the template, and to be lowered when the mattress is to be moved relative to the frame (loading operation), during the working of the beading machine.

The frame for the template may be formed in two parts, mutually adjustable in position according to the size of the template (and thus of the mattress) and of the sheath to be formed.

The invention will be better understood by following the attached drawing, which shows a practical non limitative exemplification of the invention. In the drawing:

FIG. 5 shows a schematic section of a cover or sheath going to be formed; and

FIG. 6 shows some working stages.

Figure 1:
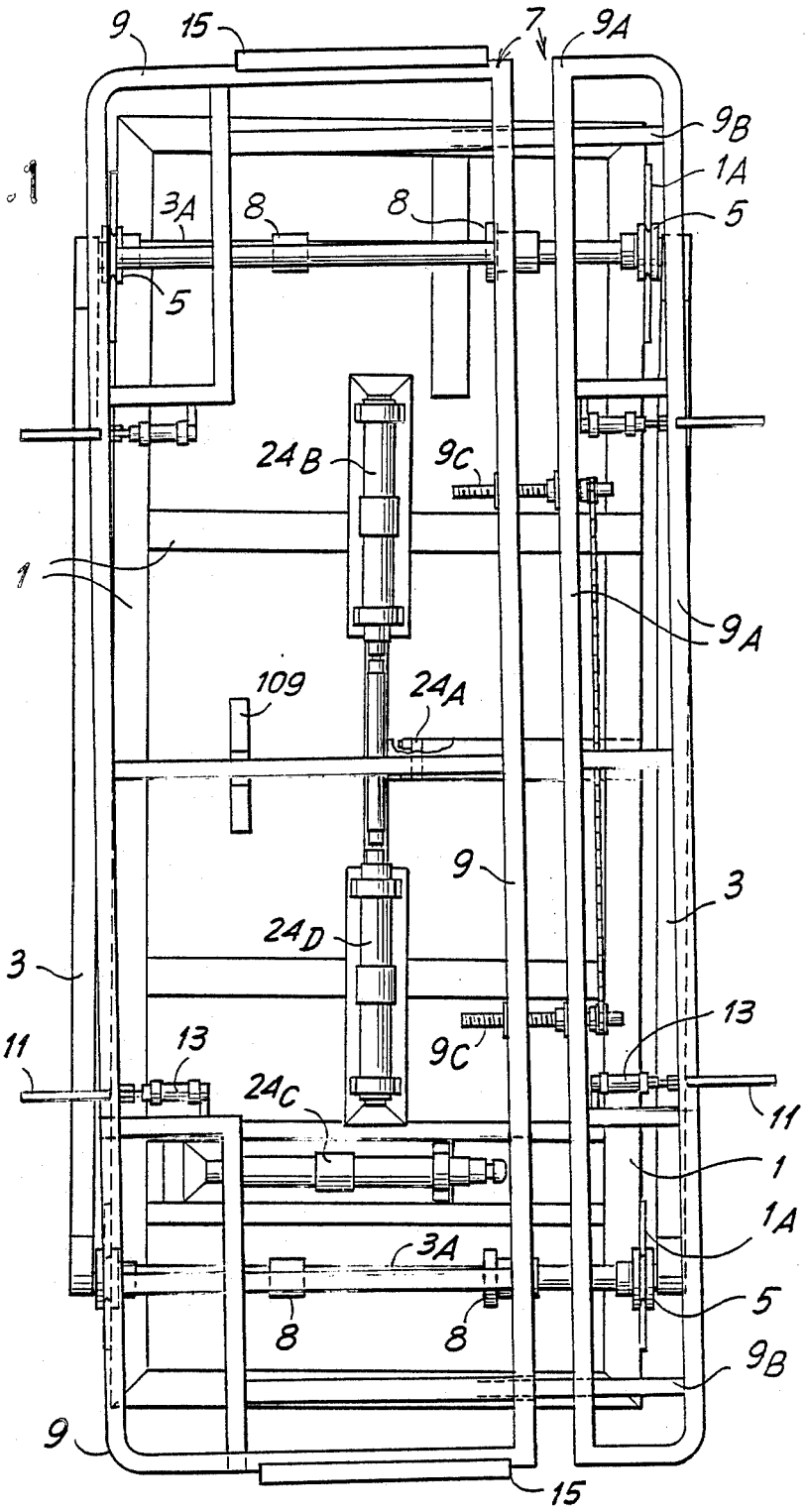
FIG. 1 shows a plan view.
Figure 2:
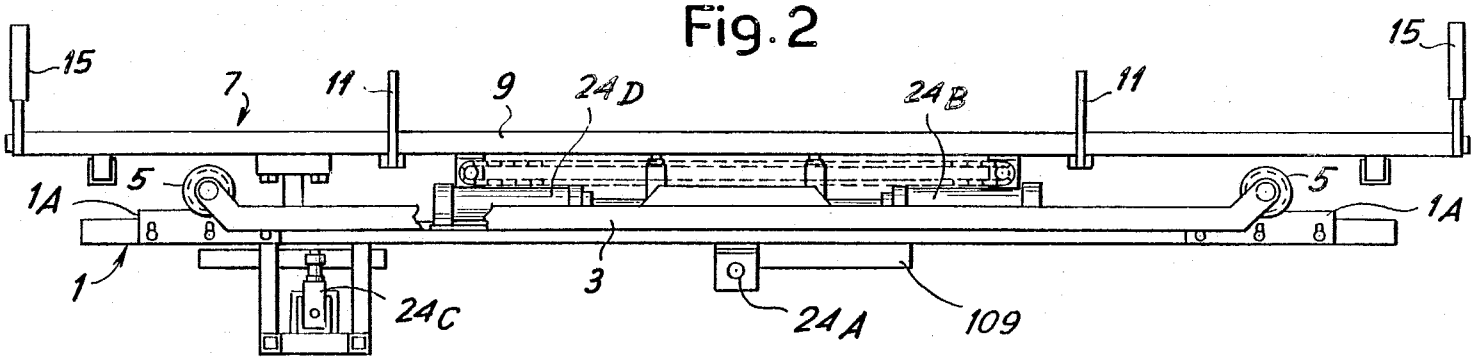
FIG. 2 is a longitudinal section view.

As schematically illustrated in the attached drawing, 1 indicates a fixed based framework forming sliding guides for a carriage 3 having grooved wheels 5 are provided for the displacement thereof along guide portions 1A of the framework 1. On the axes of wheels 5, indicated by 3A and forming part of the carriage 3, sliding guides are provided, orthogonal to those indicated by 1A, for a mobile frame 7, having sleeves which slide on the axes 3A of carriage 3. The frame 7, which is intended to receive a template of a shape corresponding to that of the mattress for the beading, is made up of two adjustable parts to fit the frame to the size of the mattress whose sheaths have to be formed. In particular, the frame intended to receive the template of the mattress is made up of a main part 9 and a part 9A movable relative to the part 9 on guides 9B to provide a clearance between said parts 9 and 9A, which depends on the mattress width, while the frame parts 9 and 9A have fixed dimensions, because of the constant length of the mattress. The relative adjustment between part 9A and part 9 of the frame is carried out, for example, through screw adjustment systems 9C, such width adjustments being relatively infrequent, since the heights change only upon a production variation from a determined size of the mattress to a production of sheaths for mattresses of different dimensions.

In substance, the frame 9, 9A is mounted on the framework 1 through a system substantially equivalent to a cross guide—represented by guides 1A and guides 3A, to obtain displacements developed along the plane of the frame 9, 9A—and so operating as to always have the frame moved in its developed plane.

The frame 9, 9A for the mattress template, has peg-like edge retention means 11 operable by cylinder-piston systems 13 which rotate them to lower them according to arrow f11 and to raise them, so as to allow the insertion and removal of the template from the frame to be effected by horizontal movement thereof. A fixed edge 15 defines the position of the mattress head ends on the frame 9, 9A.

Figure 3:
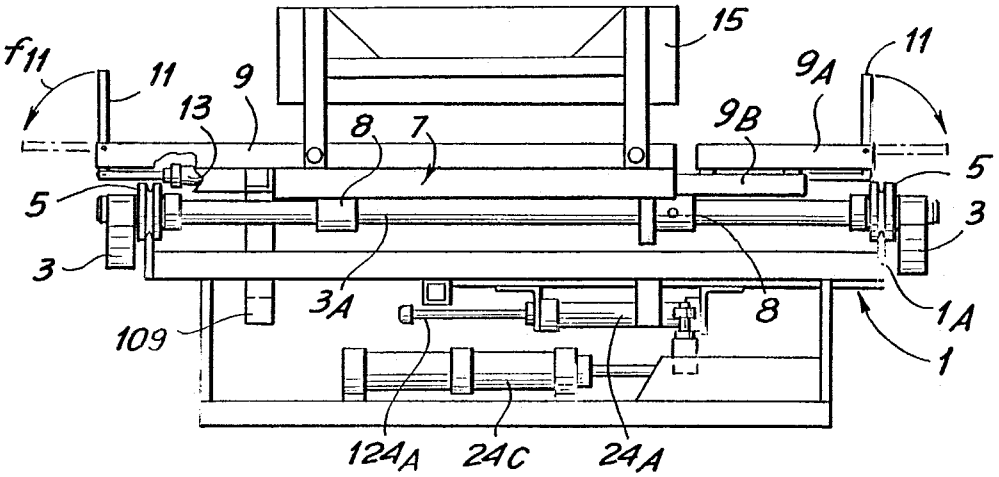
FIG. 3 is an end view partly in section.
Figure 4:
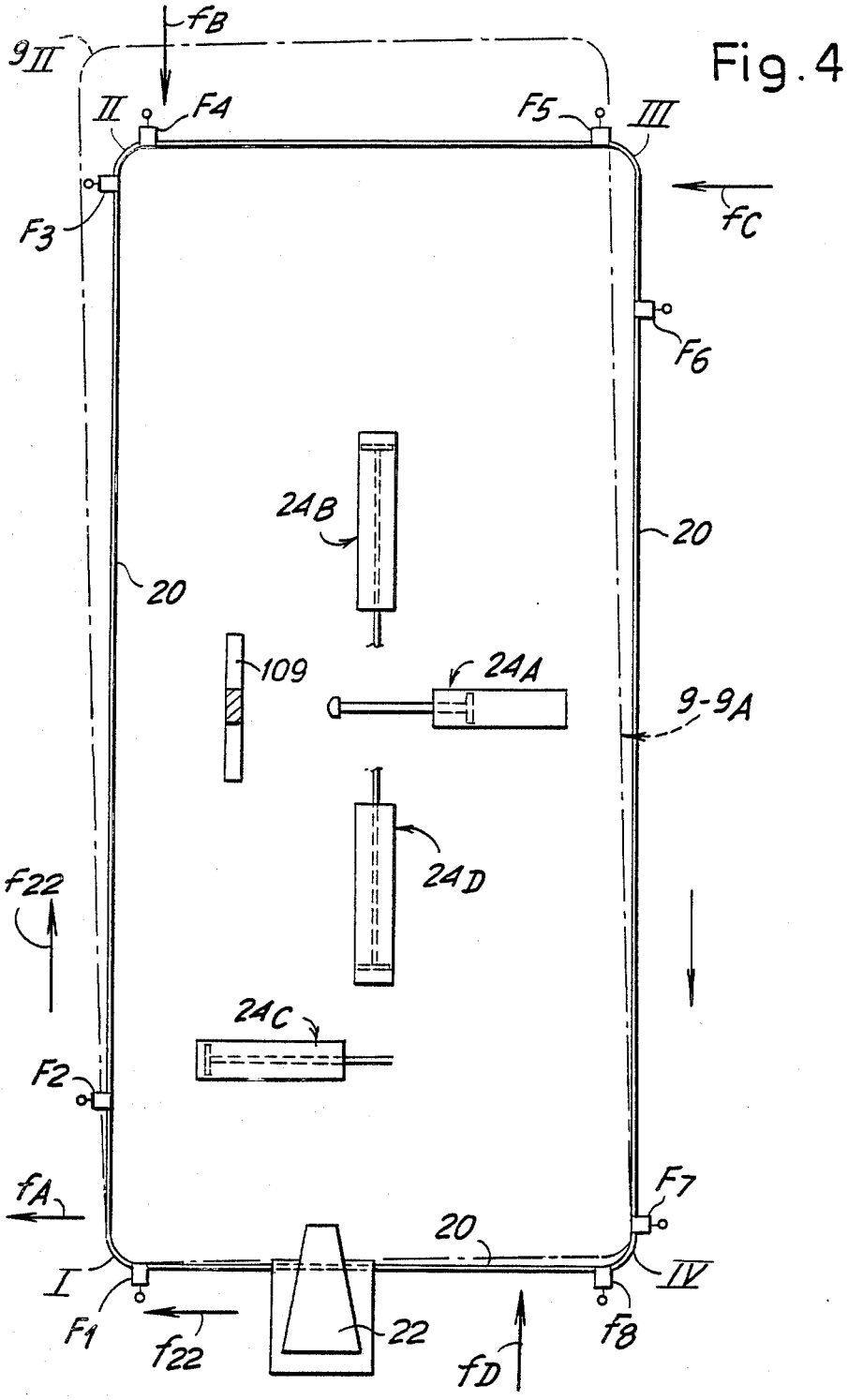
FIG. 4 shows an operation scheme.

A structure is associated with the framework not illustrated in detail, but forming a track 20 for a beading machine 22, schematically illustrated in the drawing, which is thus able to move along the track 20 according to a rectangular trajectory defined by said track. It is important that, the track 20 is inclined with respect to the displacement directions of frame 9, 9A and thus inclined with respect to the guides 1A and 3A at an angle of the order of magnitude of 1° and 30′ for the purposes indicated hereinafter. Adjacent to each curve formed by track 20 for the transit of the beading machine 22, two limit switches are provided and, in particular (see FIG. 4), for the curve I two limit switches F1 and F2, for the curve II two limit switches F3 and F4, for the curve III two limit switches F5 and F6, and for the curve IV two limit switches F7 and F8. These limit switches are operated by the machine 22 during the passage thereof along the track 20 past of each limit switch. The limit switches F1, F2 . . . F8 are arranged to control four cylinder-piston systems 24A, 24B, 24C, 24D, schematically illustrated in FIG. 4 engagable with pawls 109A, B, C and D, respectively. For example as shown in FIGS. 3 and 4, the cylinder-piston system 24A is in particular shown having a stem 124A movable to engage the pawl 109A formed by the frame 9 for the purposes explained below.

In order for the beading machine to work effectively, the material to be sewn for the beading has to be subjected to a certain pressure; accordingly, the straight paths of the track 20 are inclined, with respect to the corresponding sides of the frame, at the previously mentioned angle of approximately 1° and 30′ which permits the maintenance of the thrust of the material on the advancing machine during the travel thereof along a stretch of the track, as a result of the necessary frame displacement for its edges to be progressively lined up with the track 20 during instantaneous passage of the beading machine. In addition, the beading machine tends to drag along the material which is being sewn, and therefore the template frame as well. Moreover, the machine must be as free as possible to allow for a manoeuvre by the operator during its transit along curved corners like those indicated by I, II, II and IV. To this end, a machine advancing in the direction indicated by the arrow f22 an arriving at the limit switch F1, causes the release of any constraint of the frame 9, 9A with respect to the framework 1 and the track 20, so that the machine runs along the curve I being released from any constraint of the frame 9, 9A. When starting to move along the side in which the limit switches F1 and F3 are present, the machine tends to drag the frame in the same advancement direction according to f22 and thus displaces the frame 9, 9A, with respect to the curve II, until it takes substantially the position indicated by the broken outline 9 II in FIG. 4. The limit switch F2 controls the cylinder-piston system 24B, which acts on the frame 9, 9A, in the direction opposite to the advancement direction of the machine along the side which comprises the limit switches F2, F3; the frame 9, 9A is thereby urged in the direction of arrow $f_B$ so as to bring this frame into alignment with the side of the track 20 which comprises the limit switches F4, F5. During the advance of the machine according to f22 on the side comprising the limit switches F2 and F3, the machine itself pushes the frame inwards, thereby determining the pressure required for the beading of the edge. On its arrival at the end of run on said side, the machine acts on the limit switch F3 thereby causing the release of cylinder-piston system 24B which stops its thrust action according to fB, thereby releasing any constraint of the frame with respect to the track 20, in order to enable the machine to travel along the curve II. After encountering the limit switch F4, the machine controls the cylinder-piston 24C to urge the frame 9, 9A according to arrow fc in such a way that, at the end of the run along the side of the track 20 comprising the limit switches F4 and F5, the frame is pushed inwardly to cause the angle of the frame and thus of the template, to coincide with the angle of the curve III as in the previous stage. On encountering the limit switch F5, the action of the cylinder-piston 24C is released and the curve III is run traversed freely. Subsequently the machine starts running along the side of the track comprising the limit switches F6 and F7; by encountering the limit switch F6, the machine controls the operation of cylinder-piston system 24D which acts on the frame according to arrow fD to move it closer to the curve IV, this action being interrupted upon reaching the limit switch F7, while the frame is urged inwards along this side too, thereby determining the pressure necessary for the sewing of the band and the front of the cover or sheath to be formed. The machine, after traversing the curve IV without any constraints, comes into contact with the limit swtich F8 to control the cylinder-piston system 24A, which urges the frame according to fA to cause the last sewing run up to the release occurring when the limit switch F1 is reached.

Substantially, the apparatus according to the invention facilitates the beading of a cover by the operator, that is, the connection by the operator of a front FG of a sheath or cover with the perimetrical strip SG of the cover or sheath, as they are presented on the template D (see FIG. 5) in such a way as to have the edge of the sheath BG formed along the periphery of the front FG between the front and the strip SG during the machine travel around the annular track 20.

It is understood that the drawing merely shows an exemplification given only as a practical demonstration of the invention, which may vary in form and disposition without departing from the scope of the invention.

We claim:

1. A guide apparatus for use with a beading machine to assemble beading connecting together a front component and a side strip of a mattress sheath supported by a rectangular mattress-shaped template comprising:

a fixed base having a rectangular, perimetrically extending track;

a beading machine mounted to move in one direction along the track during assembly of the beading;

a rectangular frame for supporting the template;

cooperating mounting means on the frame and base for mounting the frame on the base to extend in generally parallel relation thereto and with the sides of the frame diverging in the direction of movement of the beading machine at a small angle from the respective corresponding adjacent sides of the track thereby imparting a corresponding divergence to corresponding sides of a supported template, the respective sides of the frame and template being sequentially progressively urged towards the respective corresponding adjacent sides of the track by the beading machined during its passage of movement along the respective sides of the track;

the mounting means including cooperating guide means on the frame and base, respectively, for limited guided movement of the frame on the base in orthogonal directions parallel to the sides of the track and in a plane parallel to the track;

thrust means extending between the frame and the base operable resiliently to urge the frame in the orthogonal directions:

means to operate the thrust means sequentially in synchronism with the position of the beading machine on the track thereby to activate the thrust means to urge the frame successively in respective orthogonal directions which are opposite to the respective directions of movement of the beading machine during its passage along the track thereby to bring the next adjacent corners of the frame, template and track successively into alignment in advance of the beading machine, the operating means being arranged to deactivate the thrust means during the passage of the beading machine through the corner to permit the frame to be freely moved on the guide means by the beading machine.

2. Guide apparatus according to claim 1, in which the means which sequentially operates the thrust means comprises switch members mounted adjacent respective exit and entry ends of the corners of the track for operation by the passage of the beading machine to activate and deactivate the thrust means, respectively.

3. Guide apparatus according to claim 2, in which the thrust means includes two pairs of cylinder-piston assemblies, respective pairs being mounted for operation on respective orthogonal axes and the individual assemblies of each pair being mounted to act in opposite directions.

4. Guide apparatus according to claim 3, in which the cylinder-piston assemblies are mounted on the base for operative engagement with pawls mounted on the frame.

5. Guide apparatus according to claim 1, in which the guide means comprises a pair of guide rails extending along the base in mutually spaced apart parallel relation in one of the orthogonal directions and the frame includes a template supporting platform and a carriage below the platform having a pair of wheels or sliders engaging the respective rails for guiding movement therealong, the carriage including an elongate guide member extending between the wheels or sliders, orthogonally of the rails, the platform including means mounting the platform for limited sliding movement along the guide member.

6. A guide apparatus for the connection beading of a front component and a side strip of a mattress sheath or cover or the like by the use of a mattress-shaped template and a beading machine, comprising: a fixed structure with perimetrical tracks for the beading machine; a frame for the template for the assembly of the sheath components; orthogonally extending guide means including guide rails extending in one direction along the fixed structure and an intermediate element having wheels or slides for engagement with the rails for movement of the intermediate element therealong in the one direction, the intermediate element forming guides that extend orthogonally to the rails for engagement with slides carried by the frame in order to permit the displacement of the frame in the said orthogonal directions in its plane and at a limited inclination with respect to said tracks; pairs of elastic thrust means operatively extending between the fixed structure and the frame and arranged with the pairs extending in the orthogonal directions and the thrust means of each pair acting in opposite directions, the thrust means being arranged for selective activation according to the position on the track reached by the beading machine, the thrust means being arranged to react on the structure to move the frame to align a corner thereof with a corresponding corner of the track immediately before passage of the beading machine around the corner, and to release the frame for free movement thereof along the guide means during the beading of the corresponding corner.

7. Apparatus according to claim 6, in which said elastic thrust means are pneumatic cylinder-piston devices releasably acting on pawls on the frame; and in which limit switches are provided adjacent to the corners of the tracks and aligned for actuation by the beading machine to operate the cylinder-piston devices.

8. Apparatus according to claim 6, in which the frame for the template comprises edge means for retaining the template thereon which edge means are controlled by piston and cylinder means arranged to raise and lower the edge means to trap and to release the template respectively, permitting the replacement of the template during the operation of the beading machine.

9. Apparatus according to claim 6, in which the frame for the template comprises two parts mounted together for mutual adjustment of their relative positions to accommodate templates of different dimensions.

* * * * *